US008277008B2

(12) United States Patent
Tsukamoto

(10) Patent No.: US 8,277,008 B2
(45) Date of Patent: Oct. 2, 2012

(54) METHOD AND APPARATUS FOR DRIVING INKJET HEAD

(75) Inventor: Ryuji Tsukamoto, Kanagawa-ken (JP)

(73) Assignee: FUJIFILM Corporation, Tokyo (JP)

( * ) Notice: Subject to any disclaimer, the term of this patent is extended or adjusted under 35 U.S.C. 154(b) by 245 days.

(21) Appl. No.: 12/872,858

(22) Filed: Aug. 31, 2010

(65) Prior Publication Data

US 2011/0050769 A1 Mar. 3, 2011

(30) Foreign Application Priority Data

Sep. 1, 2009 (JP) ..... 2009-201732

(51) Int. Cl.
*B41J 29/38* (2006.01)

(52) U.S. Cl. ..... 347/10

(58) Field of Classification Search ..... 347/9–11, 347/68

See application file for complete search history.

(56) References Cited

U.S. PATENT DOCUMENTS

| | | | | |
|---|---|---|---|---|
| 6,840,595 | B2 * | 1/2005 | Kusunoki | 347/10 |
| 7,334,856 | B2 * | 2/2008 | Hamazaki et al. | 347/10 |
| 8,172,352 | B2 * | 5/2012 | Okada et al. | 347/11 |
| 2002/0018083 | A1 | 2/2002 | Sayama | |

FOREIGN PATENT DOCUMENTS

| | | | |
|---|---|---|---|
| JP | 2002-103619 | A | 4/2002 |
| JP | 2004-209843 | A | 7/2004 |

* cited by examiner

*Primary Examiner* — An Do
(74) *Attorney, Agent, or Firm* — Birch, Stewart, Kolasch & Birch, LLP

(57) ABSTRACT

A method for driving an inkjet head includes applying drive signals including an ejection signal used for ejecting ink and a non-ejection signal used for not ejecting the ink, to an actuator provided with a pressure chamber at a constant cycle so as to increase or reduce pressure in the pressure chamber in such a manner that the ink is ejected or not ejected from a nozzle connected with the pressure chamber, wherein: a waveform of the ejection signal includes a combination of an ejection pulse for causing a droplet of the ink to be ejected from the nozzle and a non-ejection pulse for not causing a droplet of the ink to be ejected from the nozzle, the ejection pulse of the waveform of the ejection signal includes a part for reducing the pressure in the pressure chamber and a part for increasing the reduced pressure in the pressure chamber.

16 Claims, 25 Drawing Sheets

FIG.7

| NON-EJECTION PULSE VOLTAGE / EJECTION PULSE VOLTAGE | INK DEVIATION STATUS | INK DRYNESS STATUS | PRESENCE/ABSENCE OF EJECTION OF INK BY NON-EJECTION PULSE |
|---|---|---|---|
| 0.00 | POOR | POOR | ABSENT |
| 0.05 | GOOD | POOR | ABSENT |
| 0.10 | GOOD | GOOD | ABSENT |
| 0.30 | GOOD | GOOD | ABSENT |
| 0.50 | GOOD | GOOD | ABSENT |
| 0.70 | GOOD | GOOD | ABSENT |
| 0.75 | POOR | GOOD | PRESENT |
| 0.80 | POOR | GOOD | PRESENT |
| 0.90 | POOR | GOOD | PRESENT |
| 1.00 | POOR | GOOD | PRESENT |

METHOD AND APPARATUS FOR DRIVING INKJET HEAD

BACKGROUND OF THE INVENTION

1. Field of the Invention

The present invention relates to a method and apparatus for driving an inkjet head. The present invention particularly relates to a method and apparatus for driving an inkjet head, whereby the pressure in a pressure chamber is increased or reduced and ink is ejected or not ejected from a nozzle communicated with the pressure chamber by applying drive signals having predetermined drive waveforms to an actuator provided with the pressure chamber.

2. Description of the Related Art

An inkjet recording apparatus ejects ink droplets selectively from a plurality of nozzles formed on an inkjet head, to record an image on a sheet of paper. Therefore, some of the nozzles may not eject the ink for a long time. When the ink is not ejected for a long time, the ink forming meniscus in the nozzles dries out, increasing the viscosity of the ink. Such increase in the ink viscosity causes an ink ejection failure and consequently generates an abnormal image.

Japanese Patent Application Publication No. 2004-209843 discloses the technology for preventing such local increase of the ink viscosity in a meniscus part, wherein a minute drive pulse is applied at specific timing to an actuator that ejects the ink, to slightly oscillate the meniscus. More concretely, Japanese Patent Application Publication No. 2004-209843 proposes applying a minute drive pulse after an ejection pulse for ejecting the ink, so as to slightly oscillate the meniscus.

The inkjet recording apparatus often records the tones obtained by a plurality of types of dots in different sizes, in order to improve the quality of an image. In addition, as a method for changing the size of each dot, there is a known method for changing the size of each dot in accordance with the number of ejection pulses applied to the actuator. This method, for example, configures a series of drive signals by including three ejection pulses within one recording cycle, the ejection pulses being generated at regular intervals, and, when large dots are formed, all of the three ejection pulses are applied within the recording cycle. When medium-sized dots are formed, the method applies two of the three ejection pulses within the recording cycle to the actuator. When small dots are formed, the method applies one of the three ejection pulses within the recording cycle to the actuator. However, selectively applying the ejection pulses in this manner causes variations in the application intervals when recording the same dots continuously, and causes the ink droplets to deviate the courses thereof or causes fluctuations in the amount of the ink droplets, destabilizing the ejection of the ink.

Japanese Patent Application Publication No. 2002-103619 proposes the technology for configuring a drive signal applied to an actuator, from a basic ejection pulse generated every t cycle and an auxiliary ejection pulse generated after a lapse of ½ of the cycle t since the generation of the basic ejection pulse, when changing the sizes of the dots in accordance with the number of ejection pulses. In this technology, the waveforms of the basic ejection pulse and the auxiliary ejection pulse are formed into the same waveform, and at least three of the basic ejection pulses and at least one auxiliary ejection pulse are included in a recording cycle. By applying the appropriately selected basic ejection pulses and the auxiliary ejection pulses to the actuator, the application intervals for applying the ejection pulses can be made constant, across the recording cycle, in order to record the same size of dots consecutively.

The method described in Japanese Patent Application Publication No. 2004-209843 can prevent the ink from drying out but cannot prevent the ink droplets from deviating the courses thereof or stably eject the ink droplets.

The method described in Japanese Patent Application Publication No. 2002-103619, on the other hand, can prevent the ink from deviating its course but cannot prevent the ink from drying out.

Although it is possible to make up these disbenefits by combining these methods, in such a case, the waveforms of the pulses become long and the ink droplets cannot be ejected at a high frequency.

SUMMARY OF THE INVENTION

The present invention has been contrived in view of such circumstances, and an object thereof is to provide a method and apparatus for driving an inkjet head capable of preventing ink from drying out and of ejecting ink droplets stably.

In order to attain an object described above, one aspect of the present invention is directed to a method for driving an inkjet head, comprising the step of applying drive signals including an ejection signal used for ejecting ink and a non-ejection signal used for not ejecting the ink, to an actuator provided with a pressure chamber at a constant cycle so as to increase or reduce pressure in the pressure chamber in such a manner that the ink is ejected or not ejected from a nozzle connected with the pressure chamber, wherein: a waveform of the ejection signal includes a combination of an ejection pulse for causing a droplet of the ink to be ejected from the nozzle and a non-ejection pulse for not causing a droplet of the ink to be ejected from the nozzle, the ejection pulse of the waveform of the ejection signal includes a part for reducing the pressure in the pressure chamber and a part for increasing the reduced pressure in the pressure chamber, the non-ejection pulse of the waveform of the ejection signal includes a part for reducing the pressure in the pressure chamber and a part for increasing the reduced pressure in the pressure chamber, the part for reducing the pressure in the pressure chamber of the non-ejection pulse of the waveform of the ejection signal is set to reduce the pressure in the pressure chamber while a tail of a droplet of the ink ejected from the nozzle by the ejection pulse is connected to the nozzle, the part for increasing the pressure in the pressure chamber of the non-ejection pulse of the waveform of the ejection signal is set to increase the pressure in the pressure chamber within a resonance period of the pressure chamber from a moment when the pressure in the pressure chamber is increased by the ejection pulse, and the non-ejection signal has a waveform including only a non-ejection pulse including a part for reducing the pressure in the pressure chamber and a part for increasing the reduced pressure in the pressure chamber, not to cause a droplet of the ink to be ejected from the nozzle.

According to this aspect of the invention, in the case where an ink droplet is ejected or not ejected by applying a signal having a predetermined drive waveform, at a constant cycle, to an actuator provided with a pressure chamber, when ejecting the ink, a signal of a drive waveform having a combination of an ejection pulse and a non-ejection pulse is applied to the actuator. When the ink is not ejected, a signal of a drive waveform configured only by a non-ejection pulse is applied to the actuator. By constantly applying the non-ejection pulse in this manner, the meniscus can be vibrated and the ink forming the meniscus can be prevented from drying out. Furthermore, according to this aspect of the present invention, the non-ejection pulse that is incorporated in the signal (ejection signal) applied when the ink is ejected is incorporated after the ejection pulse is applied, the pressure in the pressure chamber is reduced while the tail of an ink droplet ejected from a nozzle by the ejection pulse is connected to the nozzle, and increase the pressure in the pressure chamber within a resonance period of the pressure chamber from the moment when the ejection pulse increases the pressure in the pressure chamber. In this manner, the ink droplet ejected from the nozzle can be prevented from deviating the course thereof, by applying the ejection pulse. In other words, because the pressure in the pressure chamber is reduced while the tail of the ink droplet is connected to the nozzle, the ink droplet being ejected from the nozzle by the application of the ejection pulse, the tail of the ink droplet ejected from the nozzle by the application of the ejection pulse can be cut short. By increasing the pressure in the pressure chamber within the resonance period of the pressure chamber from the moment when the pressure in the pressure chamber is increased by the ejection pulse, the pressure in the pressure chamber can be increased when the meniscus is drawn in, and the meniscus can be inhibited from vibrating. By cutting the ink droplet short and inhibiting the meniscus from vibrating as described above, the ink droplet can be effectively prevented from deviating the course thereof. Moreover, since the waveform (signal) configuring one cycle is not elongated, ink droplets can be ejected at a high frequency.

Desirably, the non-ejection pulse which is incorporated in the waveform of the non-ejection signal is incorporated in a same position as the non-ejection pulse which is incorporated in the waveform of the ejection signal.

According to this aspect of the invention, the non-ejection pulse that is incorporated in the drive waveform applied when the ink is not ejected is incorporated in the same position (the same position within one cycle) as the non-ejection pulse that is incorporated in the drive waveform applied when the ink is ejected.

Desirably, a peak value of the non-ejection pulse is set equal to or greater than 10%, but not greater than 70%, of a maximum peak value of the ejection pulse.

According to this aspect of the invention, the peak value of the non-ejection pulse is set at equal to or greater than 10%, but not greater than 70%, of the maximum peak value of the ejection pulse. Thus, the meniscus can be slightly vibrated without ejecting an ink droplet from the nozzle, and the ink droplet can be inhibited from deviating the course thereof.

Desirably, one or more of the ejection pulses are incorporated in the waveform of the ejection signal, a dot diameter of a droplet of the ink deposited on a recording medium is changed by changing number of the ejection pulses of the ejection signal, the part for reducing the pressure in the pressure chamber of the non-ejection pulse of the ejection signal is set to reduce the pressure in the pressure chamber while the tail of a droplet of the ink ejected from the nozzle by the last ejection pulse is connected to the nozzle, and the part for increasing the pressure in the pressure chamber of the non-ejection pulse of the ejection signal is set to increase the pressure in the pressure chamber within the resonance period of the pressure chamber from the moment when the pressure in the pressure chamber is increased by the last ejection pulse.

According to this aspect of the invention, one or more ejection pulses are incorporated in the drive waveform applied when the ink is ejected. By changing the number of ejection pulses, the dot diameter of each ink droplet deposited on a sheet can be changed. Consequently, gradation recording using a plurality of types of dots in different sizes can be achieved, whereby a high-quality image can be recorded.

Desirably, a plurality of ejection pulses incorporated in the waveform of the ejection signal are set such that peak values of the plurality of ejection pulses increase gradually.

According to this aspect of the invention, a plurality of ejection pulses are incorporated in the drive waveform applied when the ink is ejected, and the peak value of each of the ejection pulses is set to increase gradually. In this way, in a case where a plurality of ejection pulses are incorporated into the drive waveform applied when the ink is ejected, the peak value of each ejection pulse is set to increase gradually, an ink droplet that is ejected afterwards can catch up with a previously ejected ink droplet, so that the ink droplets can be deposited in the form of one ink droplet onto a recording medium. Because the ejected ink droplets can be deposited in a neat shape by being deposited in the form of one ink droplet, a higher quality image can be recorded.

Desirably, the peak values of the plurality of ejection pulses increase gradually in such a manner that a droplet of the ink ejected subsequently from the nozzle catches up with a droplet of the ink ejected previously from the nozzle so as to be deposited on the recording medium in form of one droplet.

Desirably, a plurality of ejection pulses incorporated in the waveform of the ejection signal have a same peak value.

Desirably, a plurality of ejection pulses incorporated in the waveform of the ejection signal have a regular time interval.

In order to attain an object described above, another aspect of the present invention is directed to an apparatus for driving an inkjet head, for applying drive signals including an ejection signal used for ejecting ink and a non-ejection signal used for not ejecting the ink, to an actuator provided with a pressure chamber at a constant cycle so as to increase or reduce pressure in the pressure chamber in such a manner that the ink is ejected or not ejected from a nozzle connected with the pressure chamber, wherein: a waveform of the ejection signal includes a combination of an ejection pulse for causing a droplet of the ink to be ejected from the nozzle and a non-ejection pulse for not causing a droplet of the ink to be ejected from the nozzle, the ejection pulse of the waveform of the ejection signal includes a part for reducing the pressure in the pressure chamber and a part for increasing the reduced pressure in the pressure chamber, the non-ejection pulse of the waveform of the ejection signal includes a part for reducing the pressure in the pressure chamber and a part for increasing the reduced pressure in the pressure chamber, the part for reducing the pressure in the pressure chamber of the non-ejection pulse of the waveform of the ejection signal is set to reduce the pressure in the pressure chamber while a tail of a droplet of the ink ejected from the nozzle by the ejection pulse is connected to the nozzle, the part for increasing the pressure in the pressure chamber of the non-ejection pulse of the waveform of the ejection signal is set to increase the pressure in the pressure chamber within a resonance period of the pressure chamber from a moment when the pressure in the pressure chamber is increased by the ejection pulse, the non-ejection signal has a waveform including only a non-ejection pulse including a part for reducing the pressure in the pressure chamber and a part for increasing the reduced pressure in the pressure chamber, not to cause a droplet of the ink to be ejected from the nozzle, when a droplet of the ink is ejected from the nozzle, the ejection signal is applied to the actuator provided with the pressure chamber, and when a droplet of the ink is not ejected from the nozzle, the non-ejection signal is applied to the actuator provided with the pressure chamber.

According to this aspect of the invention, in the case where an ink droplet is ejected or not ejected by applying a drive signal having a predetermined drive waveform, at a constant cycle, to an actuator provided with a pressure chamber, when ejecting the ink, a drive signal of a drive waveform having a combination of an ejection pulse and a non-ejection pulse is applied to the actuator. When the ink is not ejected, a drive signal of a drive waveform configured only by the non-ejection pulse is applied to the actuator. By constantly applying the non-ejection pulse in this manner, the meniscus can be vibrated and the ink forming the meniscus can be prevented from drying out. Furthermore, according to this aspect of the present invention, the non-ejection pulse that is incorporated in the drive signal applied when the ink is ejected is incorporated after the ejection pulse is applied, the pressure in the pressure chamber is reduced while the tail of an ink droplet ejected from the nozzle by the ejection pulse is connected to the nozzle, and the pressure in the pressure chamber is increased within a resonance period of the pressure chamber from the moment when the ejection pulse increases the pressure in the pressure chamber. In this manner, the ink droplet ejected from the nozzle can be prevented from deviating the course thereof, by applying the ejection pulse. In other words, because the pressure in the pressure chamber is reduced while the tail of the ink droplet is connected to the nozzle, the ink droplet being ejected from the nozzle by the application of the ejection pulse, the tail of the ink droplet ejected from the nozzle by the application of the ejection pulse can be cut short. By increasing the pressure in the pressure chamber within the resonance period thereof from the moment when the pressure in the pressure chamber is increased by the ejection pulse, the pressure in the pressure chamber can be increased when the meniscus is drawn in, and the meniscus can be inhibited from vibrating. By cutting the ink droplet short and inhibiting the meniscus from vibrating as described above, the ink droplet can be effectively prevented from deviating the course thereof. Moreover, the waveform (signal) configuring one cycle is not elongated, and therefore ink droplets can be ejected at a high frequency.

Desirably, the non-ejection pulse which is incorporated in the waveform of the non-ejection signal is incorporated in a same position as the non-ejection pulse which is incorporated in the waveform of the ejection signal.

According to this aspect of the invention, the non-ejection pulse that is incorporated in the drive waveform applied when the ink is not ejected is incorporated in the same position (the same position within one cycle) as the non-ejection pulse that is incorporated in the drive waveform applied when the ink is ejected.

Desirably, a peak value of the non-ejection pulse is set equal to or greater than 10%, but not greater than 70%, of a maximum peak value of the ejection pulse.

According to this aspect of the invention, the peak value of the non-ejection pulse is set at equal to or greater than 10%, but not greater than 70%, of the maximum peak value of the ejection pulse. Thus, the meniscus can be slightly vibrated without ejecting an ink droplet from the nozzle, and the ink droplet can be inhibited from deviating the course thereof.

Desirably, one or more of the ejection pulses are incorporated in the waveform of the ejection signal, a dot diameter of a droplet of the ink deposited on a recording medium is changed by changing number of the ejection pulses of the ejection signal, the part for reducing the pressure in the pressure chamber of the non-ejection pulse of the ejection signal is set to reduce the pressure in the pressure chamber while the tail of a droplet of the ink ejected from the nozzle by the last ejection pulse is connected to the nozzle, and the part for increasing the pressure in the pressure chamber of the non-ejection pulse of the ejection signal is set to increase the pressure in the pressure chamber within the resonance period of the pressure chamber from the moment when the pressure in the pressure chamber is increased by the last ejection pulse.

According to this aspect of the invention, one or more ejection pulses are incorporated in the drive waveform applied when the ink is ejected. By changing the number of ejection pulses, the dot diameter of each ink droplet deposited on a sheet can be changed. Consequently, gradation recording using a plurality of types of dots in different sizes can be achieved, whereby a high-quality image can be recorded.

Desirably, a plurality of ejection pulses incorporated in the waveform of the ejection signal are set such that peak values of the plurality of ejection pulses increase gradually.

According to this aspect of the invention, a plurality of ejection pulses are incorporated in the drive waveform applied when the ink is ejected, and the peak value of each of the ejection pulses is set to increase gradually. In this way, when incorporating a plurality of ejection pulses into the drive waveform applied when the ink is ejected, the peak value of each ejection pulse is set to increase gradually, an ink droplet that is ejected afterwards can catch up with a previously ejected ink droplet, so that the ink droplets can be deposited in the form of one ink droplet onto a recording medium. Because the ejected ink droplets can be deposited in a neat shape by being deposited in the form of one ink droplet, a higher quality image can be recorded.

Desirably, the peak values of the plurality of ejection pulses increase gradually in such a manner that a droplet of the ink ejected subsequently from the nozzle catches up with a droplet of the ink ejected previously from the nozzle so as to be deposited on the recording medium in form of one droplet.

Desirably, a plurality of ejection pulses incorporated in the waveform of the ejection signal have a same peak value.

Desirably, a plurality of ejection pulses incorporated in the waveform of the ejection signal have a regular time interval.

The present invention can prevent ink from drying out and eject ink droplets stably.

BRIEF DESCRIPTION OF THE DRAWINGS

FIG. 7 is a table showing experimental results;

DESCRIPTION OF THE PREFERRED EMBODIMENTS

Hereinafter, preferred examples of a method and an apparatus for driving an inkjet head according to an embodiment of the present invention are described with reference to the accompanying drawings.

Entire Configuration of an Inkjet Printer

Figure 1:
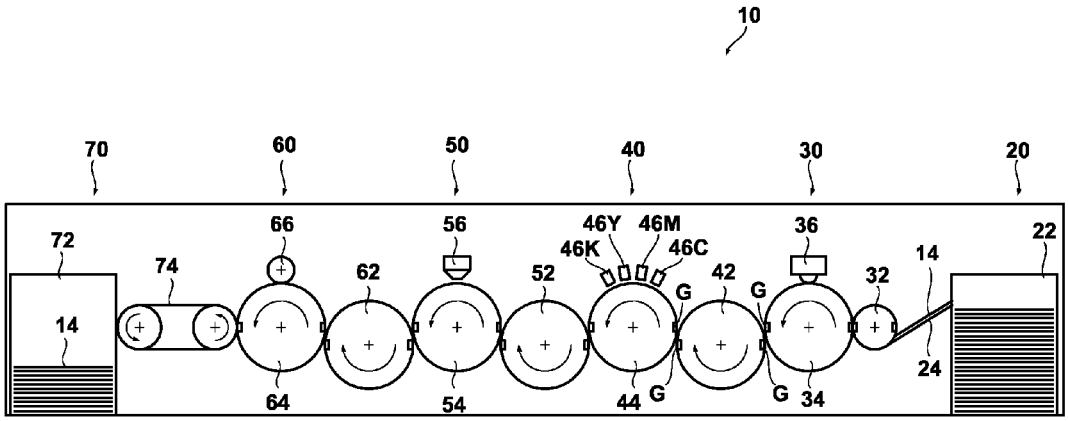
FIG. 1 is a diagram showing the entire configuration of an inkjet printer.

FIG. 1 is a diagram showing the entire configuration of an inkjet printer for printing an image on a sheet of paper by means of an inkjet method.

An inkjet printer 10 includes a paper supply unit 20 for supplying a sheet (piece of paper) 14, a treatment liquid application unit 30 for applying a predetermined treatment liquid to a front surface of the sheet 14 (image recording surface), a rendering unit 40 for depositing ink droplets from an inkjet head onto the surface of the sheet 14 to render an image, a dryer 50 for drying the ink deposited on the sheet 14, a fixing unit 60 for fixing the image rendered on the sheet 14, and a paper discharging unit 70 for discharging the sheet after printing it.

The treatment liquid application unit 30, the rendering unit 40, the dryer 50, and the fixing unit 60 are provided with impression cylinders (conveyance drums) 34, 44, 54 and 64 as conveyance devices, respectively. The sheet 14 is wrapped around the circumferential surfaces of these impression cylinders 34, 44, 54, 64 and conveyed in the treatment liquid application unit 30, rendering unit 40, dryer 50, and fixing unit 60 while rotating.

Transfer cylinders (conveyance drums) 32, 42, 52 and 62 serving as conveyance devices are disposed between the paper supply unit 20 and the treatment liquid application unit 30, between the treatment liquid application unit 30 and the rendering unit 40, between the rendering unit 40 and the dryer 50, as well as between the dryer 50 and the fixing unit 60. The sheet 14 is wrapped around the circumferential surfaces of these transfer cylinders 32, 42, 52, 62 and conveyed in each space between the units while rotating.

The impression cylinders 34, 44, 54, 64 and the transfer cylinders 32, 42, 52, 62 are disposed alternately and driven by motors that are not shown, to rotate in directions opposite to each other. In other words, the impression cylinders 34, 44, 54, 64 are rotated in a counterclockwise direction in FIG. 1, while the transfer cylinders 32, 42, 52, 62 are rotated in a clockwise direction in FIG. 1.

Note that the circumferential surfaces of the impression cylinders 34, 44, 54, 64 and the transfer cylinders 32, 42, 52, 62 are each provided with grippers G for gripping a leading end of the sheet 14. The sheet 14 is conveyed while being gripped by the grippers G at the leading end part of the sheet 14. The grippers G are disposed in two sections (positions away from each other by 180 degrees) on each of the circumferential surfaces of the impression cylinders 34, 44, 54, 64 and of the transfer cylinders 32, 42, 52, 62, and grip the sheets 14 in turns which are supplied continuously. The impression cylinders 34, 44, 54, 64 and the transfer cylinders 32, 42, 52, 62 deliver/receive the sheet 14 while the positions of the grippers G are synchronized.

Note that the sheet 14 is wrapped around the circumferential surfaces of the impression cylinders 34, 44, 54, 64 with its image recording surface (front surface) on the outside, and is wrapped around the circumferential surfaces of the transfer cylinders 32, 42, 52, 62 with the other side (rear surface) opposite from the image recording surface of the sheet 14 on the outside.

The sheet 14 that is supplied by the paper supply unit 20 is delivered to the impression cylinder 34 of the treatment liquid application unit 30 via the transfer cylinder 32, and is then delivered from the impression cylinder 34 of the treatment liquid application unit 30 to the impression cylinder 44 of the rendering unit 40 via the transfer cylinder 42. The sheet 14 is then delivered from the impression cylinder 44 of the rendering unit 40 to the impression cylinder 54 of the dryer 50 via the transfer cylinder 52, and is then delivered from the impression cylinder 54 of the dryer 50 to the impression cylinder 64 of the fixing unit 60 via the transfer cylinder 62. The sheet 14 is further transferred from the impression cylinder 64 of the fixing unit 60 to the paper discharging unit 70. In this series of conveyance processes, the sheet 14 passes through the treatment liquid application unit 30, the rendering unit 40, the dryer 50 and the fixing unit 60, is then subjected to a required process at each unit, and thereby an image is formed on the front surface (image recording surface).

The configuration of each of the units (the paper supply unit 20, the treatment liquid application unit 30, the rendering unit 40, the dryer 50, the fixing unit 60, and the paper discharging unit 70) of the inkjet printer 10 of the present embodiment is described hereinafter.

Paper Supply Unit

The paper supply unit 20 has a paper supply apparatus 22 and a paper tray 24 for continuously supplying sheets (coated paper, for example) 14 one by one.

The paper supply apparatus 22 supplies, to the paper tray 24, the sheets 14 that are stored in a stacked state in a stacker that is not shown, one by one sequentially from the top.

The paper tray 24 sends the sheets 14 that are sequentially supplied one by one from the paper supply apparatus 22, toward the transfer cylinder 32.

The sheets 14 that are sent out from the paper tray 24 are delivered to the impression cylinder 34 of the treatment liquid application unit 30 via the transfer cylinder 32.

Although the type of the sheet 14 is not particularly limited, a print sheet is used here. The print sheet is distinguished between non-coated paper and coated paper based on the presence/absence of a coating material (kaolin) that is applied in order to enhance the smoothness and ink absorption. The coated paper is further categorized into art paper, coat paper, and lightweight coated paper based on the thickness of the coating. Sheets of a variety of coated paper are used in the present embodiment.

Treatment Liquid Application Unit

The treatment liquid application unit 30 applies a predetermined treatment liquid to the front surface of the sheet 14. The treatment liquid application unit 30 includes the impression cylinder (treatment liquid drum) 34 for conveying the sheet 14, and a treatment liquid application apparatus 36 for applying the predetermined treatment liquid to the front surface (image recording surface) of the sheet 14 conveyed by the treatment liquid drum 34.

The treatment liquid drum 34 receives the sheet 14 from the transfer cylinder 32 (by gripping the leading end of the sheet 14 using the grippers G), wraps the sheet 14 around the circumferential surface thereof, and rotates and conveys the sheet 14. In this mechanism, the treatment liquid drum 34 receives the sheet 14 from the transfer cylinder 32, with the front surface of the sheet 14 on the outside, and rotates and conveys the sheet 14.

The treatment liquid application apparatus 36 applies the predetermined treatment liquid to the front surface of the sheet 14 that is rotated and conveyed by the treatment liquid drum 34. The treatment liquid application apparatus 36 presses an application roller of which the circumferential surface is provided with the treatment liquid, so as to contact with the circumferential surface of the sheet 14, applying the treatment liquid to the front surface of the sheet 14.

Here, as the treatment liquid to be applied to the sheet 14, a liquid that functions to react with ink deposited by the rendering unit 40 so as to aggregate the color materials of the ink is used. When such treatment liquid is deposited in advance and the ink droplets are deposited to the sheet 14, the color materials of the ink droplets are aggregated immediately after the ink droplets land, and thus the color materials can be prevented from being mixed even when the ink droplets land adjacent to each other.

The treatment liquid application unit 30 is configured as described above. The front surface of the sheet 14 that is delivered from the transfer cylinder 32 to the treatment liquid drum 34 is given the treatment liquid by the treatment liquid application apparatus 36 in the course of being rotated and conveyed by the treatment liquid drum 34. Then, the sheet 14 applied with the treatment liquid is delivered from the treatment liquid drum 34 to the transfer cylinder 42 and then delivered from the transfer cylinder 42 to the impression cylinder 44 of the rendering unit 40.

Rendering Unit

The rendering unit 40 deposits the ink droplets in C, M, Y, K colors to the front surface of the sheet 14, to form a color image on the front surface of the sheet 14. This rendering unit 40 includes the impression cylinder (recording drum) 44 for conveying the sheet 14, and inkjet heads 46C, 46M, 46Y, 46K for depositing the ink droplets in C, M, Y, K colors onto the sheet 14.

The recording drum 44 receives the sheet 14 from the transfer cylinder 42 (by gripping the leading end of the sheet 14 using a gripper G), wraps the sheet 14 around the circumferential surface thereof, and rotates and conveys the sheet 14. In this mechanism, the recording drum 44 receives the sheet 14 from the transfer cylinder 42, with the front surface of the sheet 14 on the outside, and rotates and conveys the sheet 14.

When receiving the sheet 14 from the treatment liquid drum 34 of the treatment liquid application unit 30, the transfer cylinder 42 receives the sheet 14 from the treatment liquid drum 34, with the other side (rear surface) opposite to the image recording surface (front surface) on the outside, and rotates and conveys the sheet 14.

The four inkjet heads 46C, 46M, 46Y, 46K, which are disposed around the recording drum 44 at regular intervals, eject the ink droplets in the corresponding colors toward the recording drum 44. The inkjet heads 46C, 46M, 46Y, 46K are configured by line heads corresponding to the width of the sheet. A row of nozzles having the length corresponding to the width of the sheet is formed on a surface (nozzle surface) of each inkjet head facing the recording drum 44, along a direction perpendicular to a conveyance direction of the sheet 14.

The configurations of the inkjet heads 46C, 46M, 46Y, 46K and the method for driving the same are described below in detail.

The rendering unit 40 is configured as described above. The sheet 14 that is delivered from the treatment liquid drum 34 to the recording drum 44 via the transfer cylinder 42 passes under the inkjet heads 46C, 46M, 46Y, 46K while being rotated and conveyed by the recording drum 44. The ink droplets in C, M, Y, K colors are deposited on the front surface by the inkjet heads 46C, 46M, 46Y, 46K during the passage of the sheet 14, whereby the color image is recorded on the front surface.

At this process, because the treatment liquid that aggregates the color materials of the ink is applied to the sheet 14 in advance, the color materials can be prevented from being mixed, so that a high quality image can be recorded.

Note in the present embodiment that a water-based ink having thermoplastic resins dispersed therein (ink that includes at least color materials and water) is used.

The sheet 14, of which the ink droplets in C, M, Y, K colors from the inkjet heads 46C, 46M, 46Y, 46K has been ejected and thereby an image is recorded onto the front surface, is delivered from the recording drum 44 to the transfer cylinder 52, and then from the transfer cylinder 52 to the impression cylinder 54 of the dryer 50.

Dryer

The dryer 50 dries the sheet 14 on which the image is recorded. The dryer 50 includes the impression cylinder (drying drum) 54 for conveying the sheet 14, and a drying apparatus 56 that performs a drying process on the sheet 14 conveyed by the drying drum 54.

The drying drum 54 receives the sheet 14 from the transfer cylinder 52 (by gripping the leading end of the sheet 14 using a gripper G), wraps the sheet 14 around the circumferential surface thereof, and rotates and conveys the sheet 14. In this mechanism, the drying drum 54 receives the sheet 14 from the transfer cylinder 52, with the front surface of the sheet 14 on the outside, and rotates and conveys the sheet 14.

The drying apparatus 56 performs a process of evaporating the moisture present on the sheet. In other words, when the ink is deposited on the sheet 14 by the rendering unit 40, a liquid component of the ink and a liquid component of the treatment liquid that are separated by the aggregation reaction between the treatment liquid and the ink remain on the sheet, and therefore, the drying apparatus 56 performs the process of evaporating and removing the liquid components remaining on the sheet. This drying apparatus 56 evaporates and removes the liquid components present on the sheet, by blowing warm air to the sheet 14 conveyed by the drying drum 54.

The dryer 50 is configured as described above. The sheet 14 that is delivered from the recording drum 44 to the drying drum 54 via the transfer cylinder 52 is subjected to the drying process in which the warm air is blown from the drying apparatus 56 to the sheet 14 while the sheet 14 is conveyed by the drying drum 54. The sheet 14 that passes through the drying apparatus 56 is delivered from the drying drum 54 to the transfer cylinder 62 and conveyed to the fixing unit 60.

Fixing Unit

The fixing unit 60 heats and pressurizes the sheet 14 to fix the image rendered to the front surface. This fixing unit 60 includes the impression cylinder (fixing drum) 64 for conveying the sheet 14, and a heat roller 66 for performing a heating/pressurizing process on the sheet 14 that is conveyed by the fixing drum 64.

The fixing drum 64 receives the sheet 14 from the transfer cylinder 62 (by gripping the leading end of the sheet 14 using a gripper G), wraps the sheet 14 around the circumferential surface thereof, and rotates and conveys the sheet 14. In this mechanism, the fixing drum 64 receives the sheet 14 from the transfer cylinder 62, with the front surface of the sheet 14 on the outside, and rotates and conveys the sheet 14.

The heat roller 66 heats and pressurizes the ink that is dried by the dryer 50, so as to weld the thermoplastic resins dispersed in the ink so that a film of the ink is formed. The heat roller 66 also straightens cockles formed on the sheet 14 at the same time. This heat roller 66 is formed so as to correspond to the width of the sheet and heated to a predetermined temperature by an embedded heat source (infrared heater, for example). A pressurizing device which is not shown presses the heat roller 66 toward the circumferential surface of the fixing drum 64, with a predetermined pressure.

The fixing unit 60 is configured as described above. The sheet 14 that is delivered from the transfer cylinder 62 to the fixing drum 64 is heated and pressurized as the heat roller 66 is pressed and brought into contact with the front surface of the sheet 14 while the sheet 14 is conveyed by the fixing drum 64. As a result, the thermoplastic resins dispersed in the ink are adhered (weld), forming the ink into a film. In addition, the cockles formed on the sheet 14 are straightened at the same time.

The sheet 14 that is heated and pressed by the heat roller 66 is delivered from the fixing drum 64 to the paper discharging unit 70.

Paper Discharging Unit

The paper discharging unit 70 recovers the sheets 14 into a stacker 72 after a series of image recording steps are performed on the sheets 14. The paper discharging unit 70 has a conveyor 74 that conveys the sheets 14 to the stacker 72. The sheets 14 that are subjected to the fixing process by the fixing unit 60 are delivered from the fixing drum 64 to the conveyor 74. The sheets 14 are then conveyed by the conveyor 74, to the position where the stacker 72 is set. The stacker 72 is set at a predetermined recovery position, and the sheets 14 conveyed by the conveyor 74 are discharged into the stacker 72, sequentially stacked in the stacker 72, and recovered.

Printing Operations

Next, printing operations performed the inkjet printer 10 are described.

The paper supply apparatus 22 supplies the sheets 14 stored in the stacker (not shown) one by one sequentially from the top to the paper tray 24. The sheets 14 that are supplied to the paper tray 24 are delivered to the treatment liquid drum 34 of the treatment liquid application unit 30 via the transfer cylinder 32. Then, the treatment liquid is applied by the treatment liquid application apparatus 36 to the surface of each of the sheets 14 while each of the sheets 14 is conveyed by the treatment liquid drum 34.

Each sheet 14 applied with the treatment liquid is delivered from the treatment liquid drum 34 to the rendering drum 44 of the rendering unit 40 via the transfer cylinder 42. The ink droplets in corresponding colors are deposited from the inkjet heads 46C, 46M, 46Y, 46K to the sheet 14 while the sheet 14 is conveyed by the rendering drum 44, whereby the image is formed on the front surface.

The sheet 14 having the image formed on the front surface thereof is delivered from the rendering drum 44 to the drying drum 54 of the dryer 50 via the transfer cylinder 52. The warm air is blown from the drying apparatus 56 to the sheet 14 while the sheet 14 is conveyed by the drying drum 54, whereby the ink deposited onto the front surface of the sheet 14 is dried.

The sheet 14 having the dried ink is delivered from the drying drum 54 to the fixing drum 64 via the transfer cylinder 62. Then, the heat roller 66 is pressed and brought into contact with the front surface of the sheet 14 while the sheet 14 is conveyed by the fixing drum 64, whereby the ink is heated and pressurized. As a result, the image formed on the front surface of the sheet 14 is fixed.

The sheet 14 having the image fixed thereto by the fixing unit 60 is delivered to the conveyor 74 of the paper discharging unit 70, conveyed to the stacker 72 by the conveyor 74, and then discharged into the stacker.

As described above, the printing is carried out through the series of steps where paper supply, treatment liquid application, image rendering, ink drying, image fixation, and paper discharge are performed in this order.

Configurations of the Inkjet Heads

Next, the configurations of the inkjet heads 46C, 46M, 46Y, 46K provided in the rendering unit 40 are described.

Because the structures of the inkjet heads 46C, 46M, 46Y, 46K corresponding to the colors are all the same, reference numeral 100 is used to illustrate the representative inkjet head.

Figure 2:
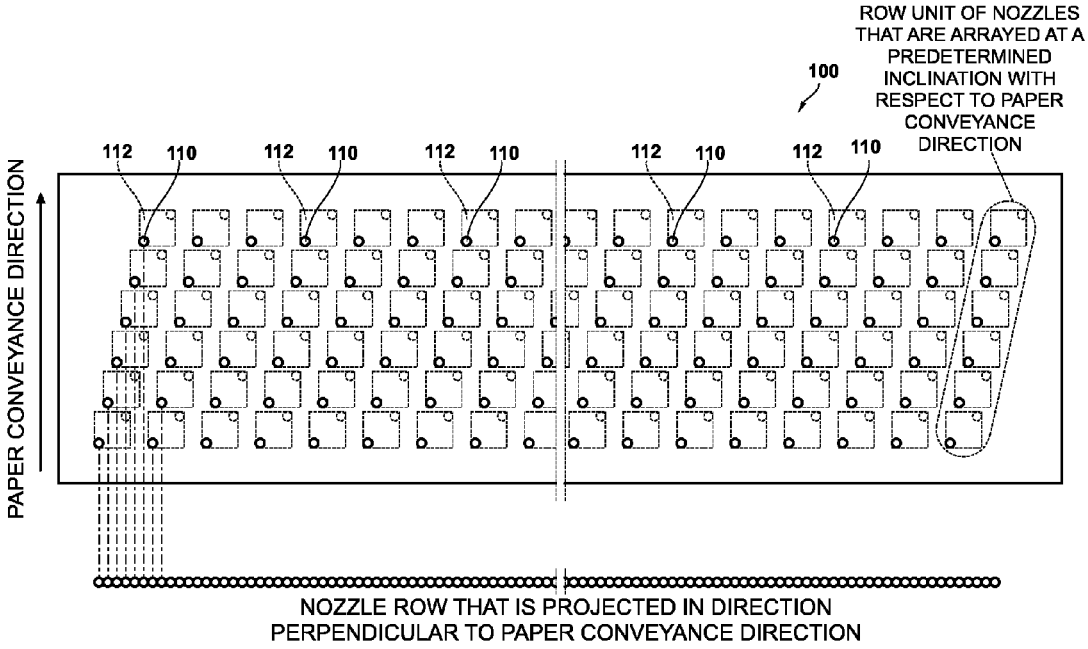
FIG. 2 is a plane perspective view of an ink ejection surface of an inkjet head.

FIG. 2 is a plane perspective view of an ink ejection surface of an inkjet head 100.

As shown in this diagram, in the inkjet head 100 of the present embodiment, nozzles 110 are arrangement in a zigzag (staggered) manner on the ink ejection surface. With such an arrangement, the substantial nozzle intervals that are projected in a longitudinal direction of the head (the direction perpendicular to the conveyance direction of the sheet) can be narrowed, so that the nozzles 110 can be made denser.

Figure 3:
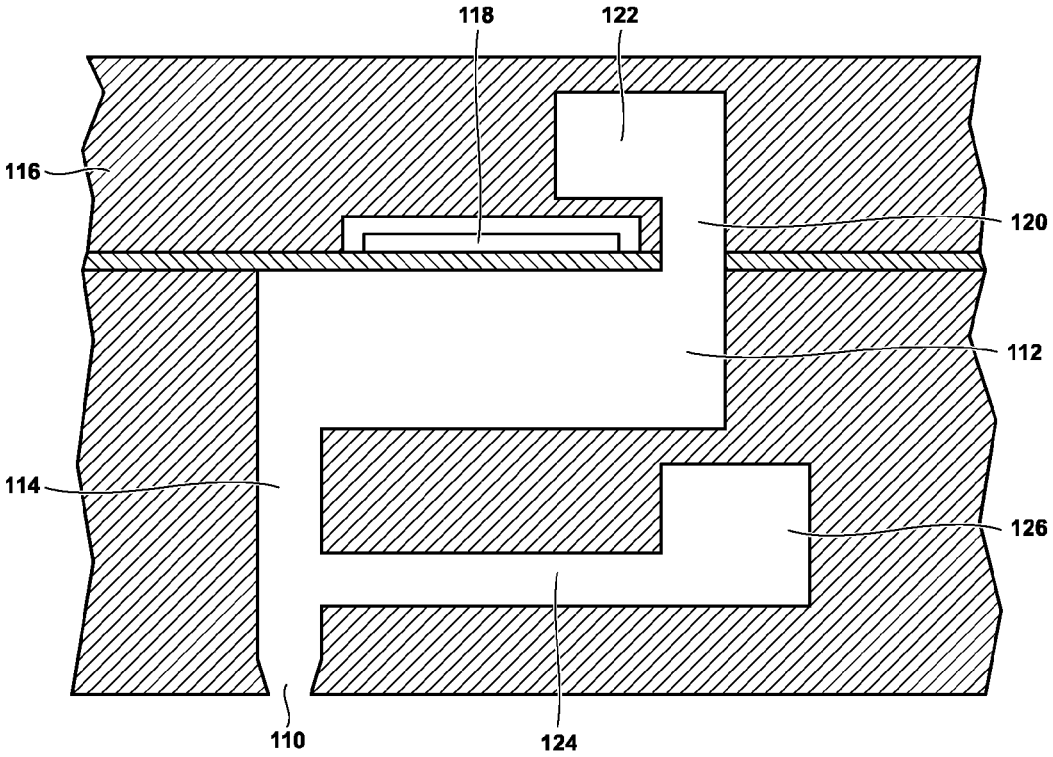
FIG. 3 is a vertical cross-sectional diagram showing an internal structure of the inkjet head.

Each of the nozzles 110 is communicated with an individually provided pressure chamber 112 through a nozzle flow path 114 (see FIG. 3).

FIG. 3 is a vertical cross-sectional diagram showing an internal structure of the inkjet head. As shown in this diagram, each pressure chamber 112 is formed as a rectangular parallelepiped space, and the nozzle flow path 114 is communicated with one corner of the bottom surface of the parallelepiped space. The nozzle flow path 114 extends vertically downward from the pressure chamber 112 and is communicated with the nozzle 110.

A ceiling of each pressure chamber 112 configured by a diaphragm 116 is formed deformably in a vertical direction. A piezoelectric element (piezo element) 118 functioning as an actuator is attached to the top of the diaphragm 116, and the diaphragm 116 deforms in the vertical direction by means of the piezoelectric element 118. By allowing the diaphragm 116 to deform in the vertical direction, the volume of the pressure chamber 112 expands and contracts, and, as a result, the pressure inside the pressure chamber 112 is reduced and increased, whereby the ink is suctioned and ejected from the nozzle 110. In other words, when the diaphragm 116 is deformed downward, the volume of the pressure chamber 112 contracts, and consequently the pressure inside the pressure chamber is increased and the ink is ejected from the nozzle 110. On the other hand, when the diaphragm 116 is deformed upward, the volume of the pressure chamber 112 expands. As a result, the pressure inside the pressure chamber is reduced and the ink is suctioned from the nozzle 110 (the ink inside the nozzle flow path 114 is drawn back into the pressure chamber 112).

Note that the piezoelectric element 118 is driven by applying a predetermined drive voltage between an individual electrode (not illustrated) provided above the piezoelectric element 118 and the diaphragm 116 serving as a common electrode. As a result, the diaphragm 116 deforms upward or downward.

One corner of the ceiling of the pressure chamber 112 (the diagonal position from the nozzle flow path 114) is communicated with an individual supply flow path 120 for supplying the ink to the pressure chamber 112. This individual supply flow path 120 is communicated with a common supply flow path 122 for supplying the ink to each of the individual supply flow paths 120.

The common supply flow path 122 is provided in a row unit of the nozzles 110 that are arrayed at an inclination with respect to the conveyance direction of the sheet 14 (see FIG. 2). The ink is supplied from this common supply flow path 122 to the pressure chambers 112 for the nozzles 110 belonging to each row, via the respective individual supply flow paths 120.

The common supply flow paths 122 for the respective rows are communicated with an ink supply flow path (not illustrated), and the ink supply flow path is communicated with an ink supply port (not illustrated). The ink is supplied from an ink tank to the ink supply port. The ink supplied to the ink supply port is supplied to the common supply flow paths 122 for the respective rows, via the ink supply flow path, and then further supplied to each pressure chamber 112 via the individual supply flow path 120.

An individual recovery flow path 124 is communicated with the middle of the nozzle low path 114. The individual recovery flow path 124 is communicated with the nozzle flow path 114 at a position in the vicinity of the nozzle 110 and extends horizontally. An end of the individual recovery flow path 124 is communicated with a common recovery flow path 126.

As with the common supply flow path 122, the common recovery flow path 126 is provided in a row unit of the nozzles 110 that are arrayed at an inclination with respect to the conveyance direction of the sheet 14. The common recovery flow paths 126 belonging to the respective rows are communicated with an ink recovery flow path (not illustrated), and the ink recovery flow path is communicated with an ink recovery port (not illustrated).

Part of the ink flowing through each flow path 114 flows to the individual recovery flow path 124 and is recovered by the common recovery flow path 126. The ink is then recovered by the ink tank from each common recovery flow path 126 via the ink recovery flow path and the ink recovery port. In other words, the ink is supplied in circulation in the inkjet head 100 of the present embodiment.

Control System of the Inkjet Head

Figure 4:
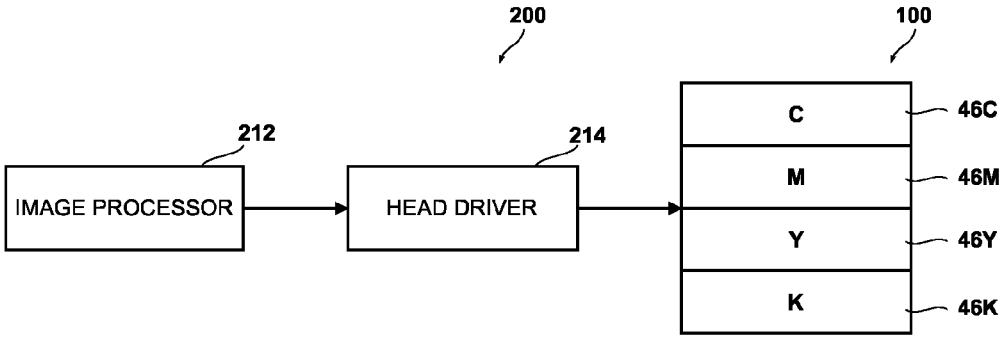
FIG. 4 is a block diagram showing a schematic configuration of a head drive controller.

FIG. 4 is a block diagram showing a schematic configuration of a head drive controller that controls the drive of the inkjet head.

As shown in the diagram, a head drive controller 200 includes an image processor 212 and a head driver 214.

The image processor 212 carries out a color conversion process, a halftone process and other required signal processes on image data (RGB image data, for example) used as a print target, to generate dot data for print control.

The head driver 214 generates a signal for driving each of the actuators (piezoelectric elements) 118 of the inkjet head 100 (46C, 46M, 46Y, 46K) based on the dot data generated by the image processor 212. The signal (drive signal) generated by the head driver 214 is applied to each actuator 118 of the inkjet head 100, whereby an ink droplet is ejected or not ejected from the corresponding nozzle 110.

Method for Driving the Inkjet Head

As described above, in the inkjet head 100, the ink droplets are ejected or not ejected from the nozzles by applying predetermined drive signals to the actuators (piezoelectric elements) corresponding to the respective nozzles. The drive signals are applied at a constant recording cycle, and when the drive signals for ejecting the ink (i.e. ejection signals) are applied, the ink droplets are ejected from the nozzles. When the drive signals for not ejecting the ink (i.e. non-ejection signals) are applied, on the other hand, the ink is not ejected from the nozzles (non-ejection).

For the nozzles for ejecting the ink droplets, the head driver 214 applies the drive signals for ejecting the ink (ejection signals) to the corresponding actuators. For the nozzles that do not eject the ink droplets, the head driver 214 applies the drive signals for not ejecting the ink (non-ejection signals) to the corresponding actuators.

Figure 5A:
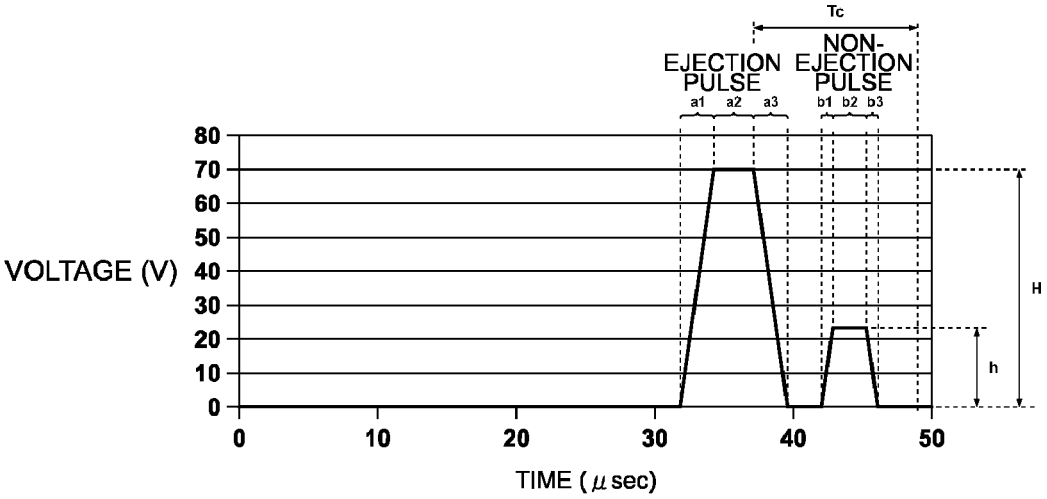
FIGS. 5A and 5B are diagrams each showing an example of a waveform of a drive signal applied to an actuator.
Figure 5B:
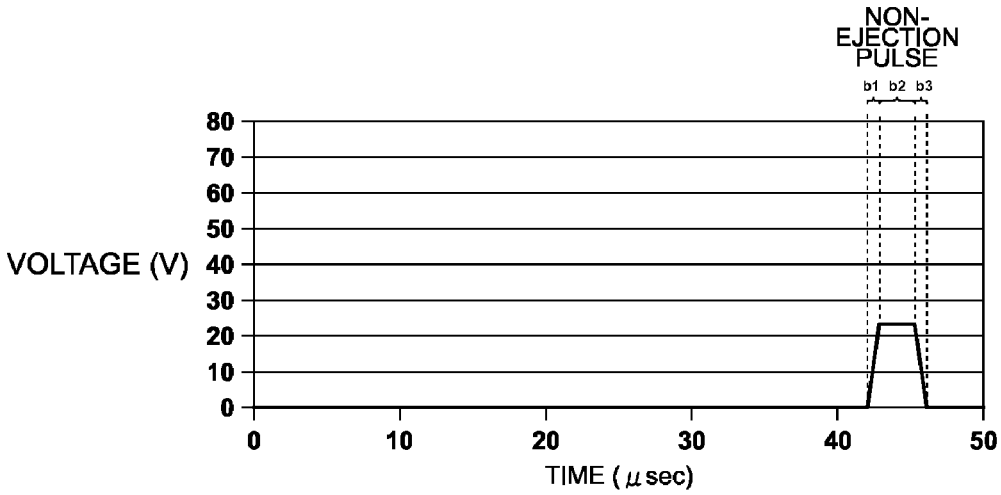
Figure 6A:
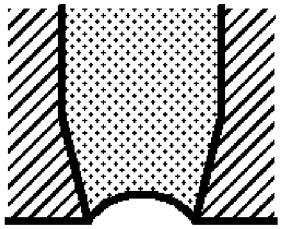
FIGS. 6A-6H illustrate a relationship between a drive waveform and a state of ejection of an ink droplet in a case where ink is ejected.
Figure 6B:
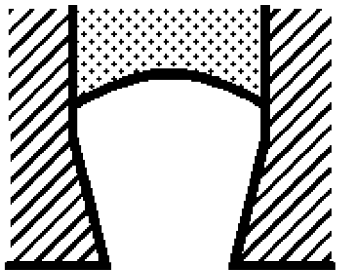
Figure 6C:
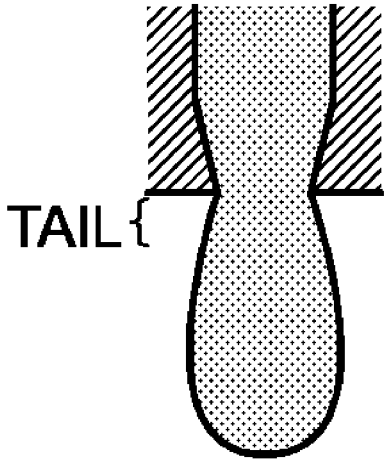
Figure 6D:
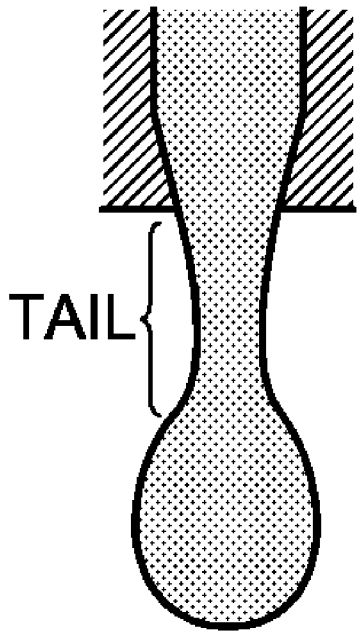
Figure 6E:
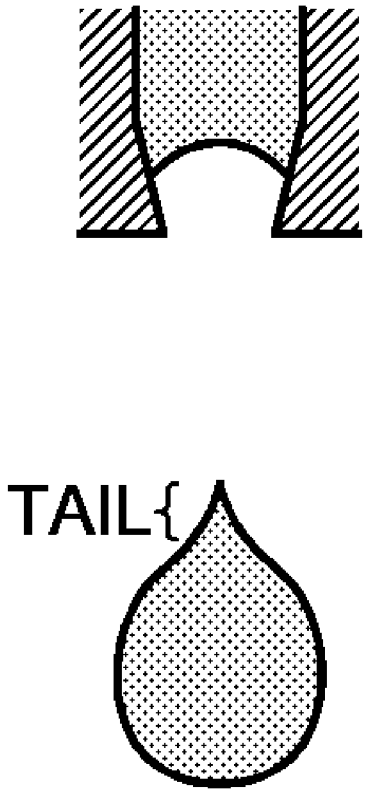
Figure 6F:
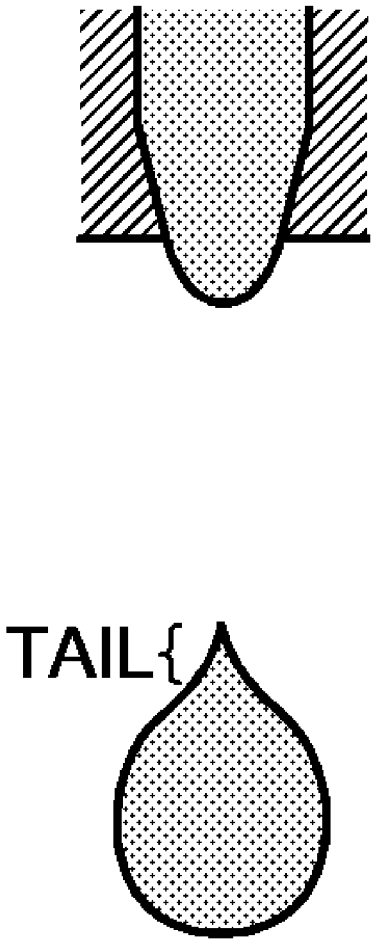
Figure 6G:
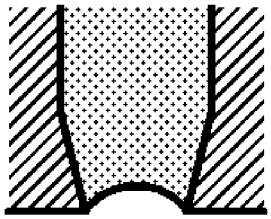
Figure 6G:
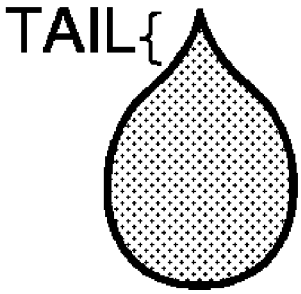
Figure 6H:
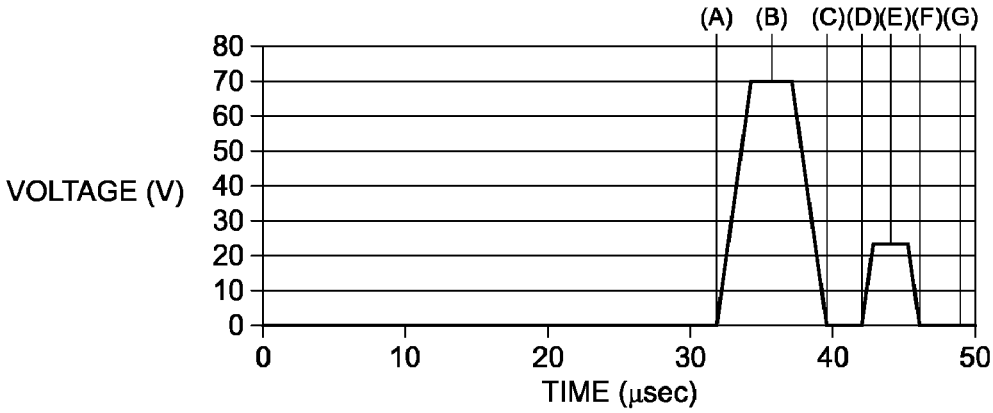

FIGS. 5A and 5B are waveform diagrams of drive signals applied to the actuators, wherein FIG. 5A shows a drive waveform of a drive signal for ejecting the ink (ejection signal), and FIG. 5B shows a drive waveform of a drive signal for not ejecting the ink (non-ejection signal).

As shown in FIG. 5A, the drive waveform of the drive signal for ejecting the ink (ejection signals) is configured by a combination of an ejection pulse for ejecting an ink droplet from a nozzle and a non-ejection pulse for not ejecting an ink from a nozzle.

The ejection pulse is configured by a part a1 for reducing the pressure in the pressure chamber, a part a2 for maintaining the reduced-pressure state for a certain period of time, and a part a3 for increasing the pressure in the pressure chamber back to the original.

Similarly, the non-ejection pulse is also configured by a part b1 for reducing the pressure in the pressure chamber, a part b2 for maintaining the reduced-pressure state for a certain period of time, and a part b3 for increasing the pressure in the pressure chamber back to the original.

The non-ejection pulse is incorporated after the ejection pulse. The part b1 for reducing the pressure in the pressure chamber is set to reduce the pressure in the pressure chamber while the tail of an ink droplet ejected from a nozzle by the ejection pulse is connected to the nozzle. In other words, as shown in FIGS. 6A-6H, an ink droplet is ejected from a nozzle by the application of the ejection pulse to an actuator. However, after the application of the ejection pulse, the ink droplet is not immediately separated from the nozzle and consequently flies while the tail of the ink droplet (rear end part of the ink droplet in a flying direction) still is connected to the nozzle. Then, the ink droplet is eventually separated from the nozzle. The part b1 of the non-ejection pulse that reduces the pressure in the pressure chamber is set to reduce the pressure in the pressure chamber while the tail of an ink droplet ejected from a nozzle by the ejection pulse is connected to the nozzle.

Furthermore, when Tc represents the resonance period of the pressure chamber, the part b3 of the non-ejection pulse that increases the pressure chamber is set to increase the pressure within the range of Tc, from the moment when the pressure in the pressure chamber is increased by the ejection pulse.

On the other hand, the drive waveform of the drive signal for not ejecting the ink (non-ejection signal) is configured only by the non-ejection pulse. This non-ejection pulse is formed into a waveform same as the drive waveform for ejecting the ink, and is also configured by the part b1 for reducing the pressure in the pressure chamber, the part b2 for maintaining the reduced-pressure state for a certain period of time, and the part b3 for increasing the pressure in the pressure chamber back to the original. Moreover, this non-ejection pulse is incorporated in the same position as the non-ejection pulse incorporated in the drive waveform for ejecting the ink (the same position within one recording cycle).

As described above, in the method for driving an inkjet head according to the present embodiment, the non-ejection pulse is applied both when ejecting the ink and when not ejecting the ink. Therefore, even when the ink is not ejected, the meniscus can be slightly vibrated (meniscus oscillation), and the ink that forms a meniscus when not being ejected can be prevented from drying out.

When ejecting the ink, the part b1 of the non-ejection pulse that reduces the pressure in the pressure chamber is set so that the pressure in the pressure chamber is reduced while the tail of an ink droplet ejected from a nozzle by the ejection pulse is connected to the nozzle, and also, the part b1 of the non-ejection pulse that increases the pressure chamber is set so that the pressure in the pressure chamber is increased within the range of Tc from the moment when the pressure is increased by the ejection pulse. Consequently, an ink droplet that is ejected from a nozzle by the application of the ejection pulse can be effectively prevented from deviating from the course thereof. Specifically, because the part b1 of the non-ejection pulse that reduces the pressure in the pressure chamber is set so that the pressure in the pressure chamber is reduced while the tail of an ink droplet ejected from a nozzle by the ejection pulse is connected to the nozzle, the tail of the ink droplet ejected from the nozzle by the ejection pulse can be cut short. Accordingly, the ink ejected from the nozzle can be inhibited from deviating from the course thereof. In addition, by setting the part b3 of the non-ejection pulse that increases the pressure in the pressure chamber so that the pressure in the pressure chamber is increased within the range of Tc from the moment when the pressure in the pressure chamber is increased by the ejection pulse, the meniscus can be prevented from vibrating, and consequently the ink ejected from the nozzles can be inhibited from deviating from the course thereof.

Note that the non-ejection pulse is set at a voltage value at which the ink is not ejected from the nozzle even when the non-ejection pulse is applied to the actuator. However, when the voltage value that is applied as the non-ejection pulse is too low, the effect of the meniscus oscillation cannot be obtained sufficiently, and the ink cannot be prevented from drying out sufficiently. Thus, the voltage that is applied as the non-ejection pulse is desirably set within the range in which the effect of the meniscus oscillation can be accomplished.

The table in FIG. 7 shows the results of an experiment for investigating the relationship between the voltage that is applied as the non-ejection pulse, the presence/absence of the deviation of the ink droplets, and the dryness of the ink forming a meniscus.

As a result of this experiment, when the voltage value of the non-ejection pulse exceeds 70% of the voltage value applied as the ejection pulse, an ink droplet was ejected from a nozzle, and it was confirmed that when the ink droplet is ejected from the nozzle, the ink droplet deviates from the course thereof.

On the other hand, it was confirmed that when the voltage value of the non-ejection pulses was below 10% of the voltage value applied as the ejection pulse, the deviation of the ink droplets could be prevented but the ink could not be inhibited from drying out.

As a result, it was confirmed that the deviation of the ink and the ink dryness could be prevented while suppressing the ejection of the ink, by setting the voltage applied as the non-ejection pulse at equal to or greater than 10%, but not greater than 70%, of the voltage applied as the ejection pulse.

Therefore, the peak value h (voltage value) of the non-ejection pulse is desirably set at equal to or greater than 10%, but not greater than 70%, of the peak value H (voltage value) of the ejection pulse ($0.1\ H \leqq h \leqq 0.7\ H$).

As described above, with the method for driving an inkjet head according to an embodiment of the present invention, both when ejecting the ink and when not ejecting the ink, the ink forming a meniscus can be effectively inhibited from drying out, by applying a predetermined non-ejection pulse to the actuators. In addition, when ejecting the ink, the part b1 of the non-ejection pulse that reduces the pressure in the pressure chamber is set so that the pressure in the pressure chamber is reduced while the tail of an ink droplet ejected from a nozzle by the ejection pulse is connected to the nozzle, and the part b3 of the non-ejection pulse that increases the pressure in the pressure chamber is set so that the pressure in the pressure chamber is increased within the range of Tc from the moment when the pressure increased by the ejection pulse. By this means, an ink droplet that is ejected by the ejection pulse can be effectively inhibited from deviating from the course thereof. Moreover, with the method for driving an inkjet head according to an embodiment of the present invention, the waveform configuring one cycle does not have to be extended, and thus the ink can be ejected at a high frequency.

Figure 8A:
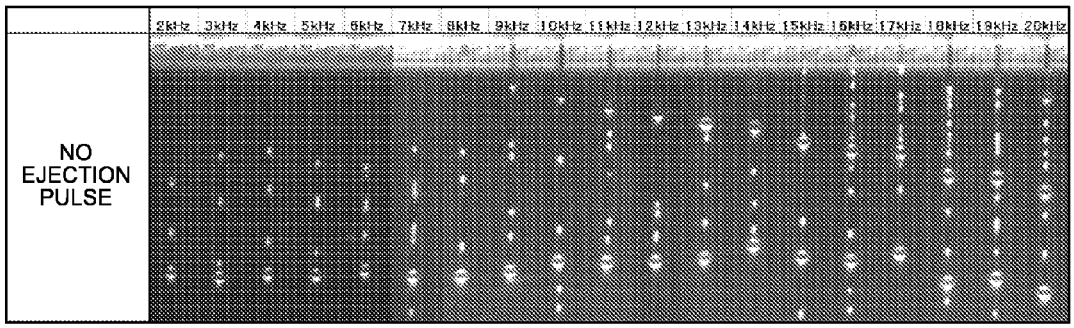
FIGS. 8A and 8B are photographs each showing a flying state of an ink droplet when an ink droplet is ejected at a different drive frequency.
Figure 8B:
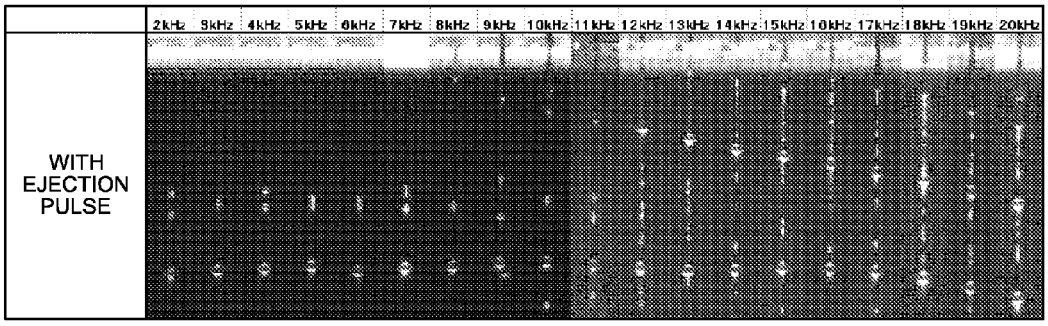

FIGS. 8A and 8B are photographs each showing a state in which an ink droplet flies when the ink droplet is ejected at a different drive frequency, wherein FIG. 8A is a photograph showing a state in which an ink droplet flies when the non-ejection pulse is not applied, and FIG. 8B is a photograph showing a state in which an ink droplet flies when the non-ejection pulse is applied.

Note that these photographs were taken 100 μsec after the ejection and show a flying state of the ink having the ejection speed of 8.5 m/sec. In these cases, the voltage of the non-ejection pulse was 20% of the voltage of the ejection pulse (non-ejection pulse voltage/ejection pulse voltage=20%).

As shown in the diagrams, it was confirmed that, by applying the non-ejection pulse, the ejection speed can be made constant when driving the inkjet head at a high frequency.

Other Embodiments

In the embodiment described above, only one ejection pulse is incorporated as the drive waveform of the drive signal for ejecting the ink (ejection signal), but a plurality of ejection pulses may be incorporated (for example, a plurality of ejection pulses may be incorporated at regular intervals). In this case, the non-ejection pulse incorporated in the drive waveform for ejecting the ink is incorporated after the last ejection pulse. Moreover, the part b1 for reducing the pressure in the pressure chamber is set to reduce the pressure in the pressure chamber while the tail of an ink droplet ejected from a nozzle by the last ejection pulse is connected to the nozzle, and the part b3 for increasing the pressure in the pressure chamber is set to increase within the range of Tc from the moment when the pressure in the pressure chamber is increased by the last ejection pulse.

When incorporating the plurality of ejection pulses, the peak values of the ejection pulses may be set to increase gradually. When incorporating the plurality of ejection pulses in the drive waveform for ejecting the ink in this way, by setting the peak values of the ejection pulses to increase gradually, the ink droplet that is ejected afterwards catches up with the previously ejected ink droplet, so that the ink droplets can be deposited in the form of one ink droplet onto a recording medium. Because the ejected ink droplets can be deposited in a neat shape by being deposited in the form of one ink droplet, a higher quality image can be recorded. In this case, the peak value (voltage) of the non-ejection pulse is set at equal to or greater than 10%, but not greater than 70%, of the maximum value of the peak value (voltage) of the ejection pulse.

Furthermore, when incorporating the plurality of ejection pulses, the dot diameter of each ink droplet to be deposited on a sheet may be changed by changing the number of ejection pulses to be incorporated.

FIGS. 9A to 9D are diagrams showing an example of drive waveforms in which a plurality of ejection pulses having the same peak value (voltage) are incorporated within one recording cycle and which include a different number of ejection pulses in order to change the dot diameter.

Figure 9A:
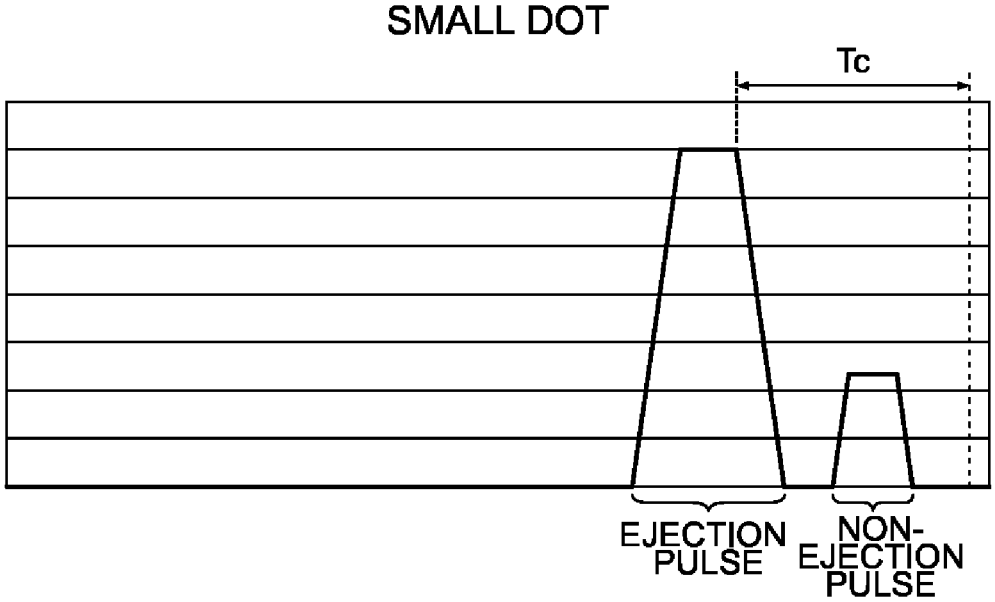
FIGS. 9A to 9D are diagrams showing another example of waveforms of the drive signal applied to an actuator.
Figure 9B:
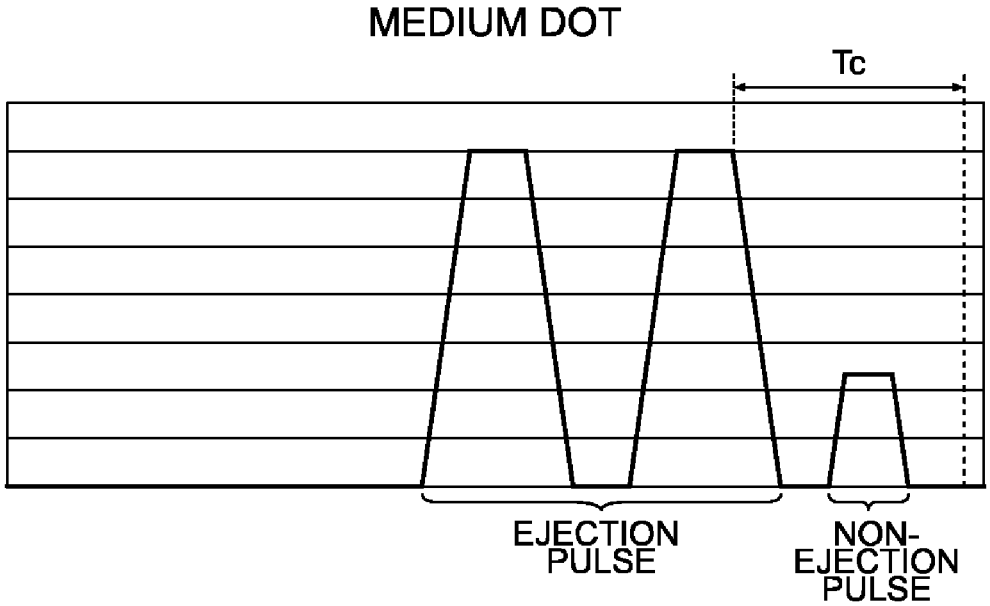
Figure 9C:
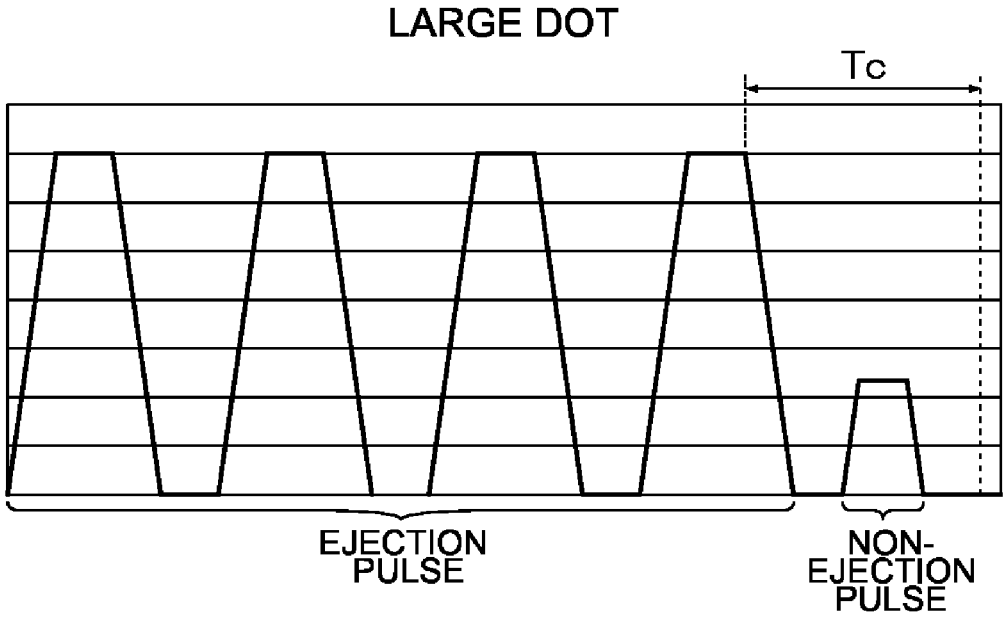
Figure 9D:
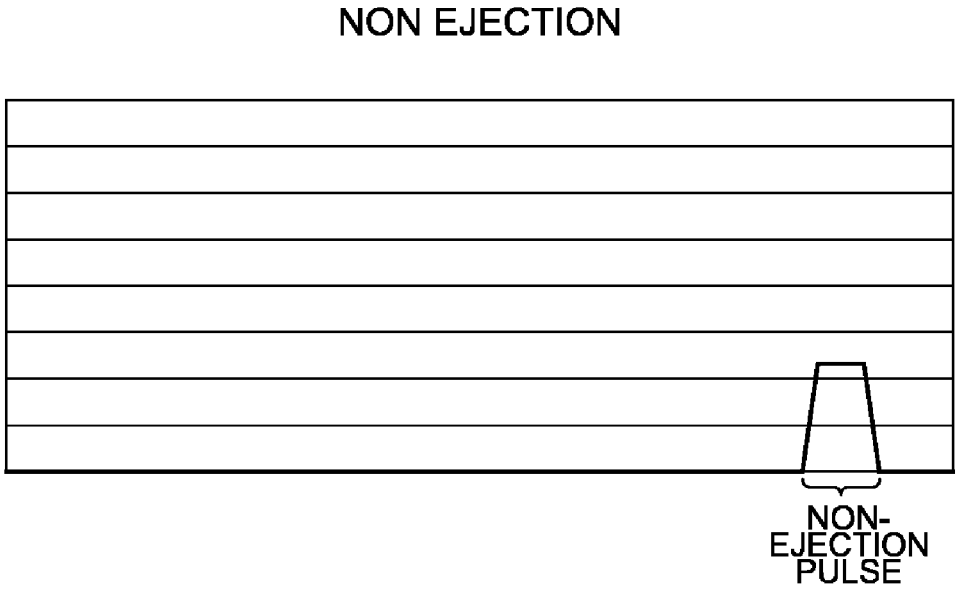

FIG. 9A shows a drive waveform for ejecting an ink droplet forming a small dot, FIG. 9B a drive waveform for ejecting an ink droplet forming a medium dot, and FIG. 9C a drive waveform for ejecting an ink droplet forming a large dot. FIG. 9D shows a drive waveform for not ejecting the ink.

As shown in FIGS. 9A to 9C, the ejection pulse(s) is incorporated at a regular time interval. A small ink dot is formed by incorporating only one ejection pulse. A medium ink dot is formed by incorporating two ejection pulses. A large ink dot is formed by incorporating four ejection pulses.

By enabling forming a plurality of types of dots in different sizes as described above, gradation recording can be performed. When the gradation recording can be performed, higher quality printing can be achieved.

As shown in FIGS. 9A to 9D, a non-ejection pulse is set to be incorporated always in the same position no matter whether the ink is ejected or not.

FIGS. 10A to 10D show an example of drive waveforms in which ejection pulses having the gradually increased peak values are incorporated and which include a different number of ejection pulses in order to change the dot diameter.

Figure 10A:
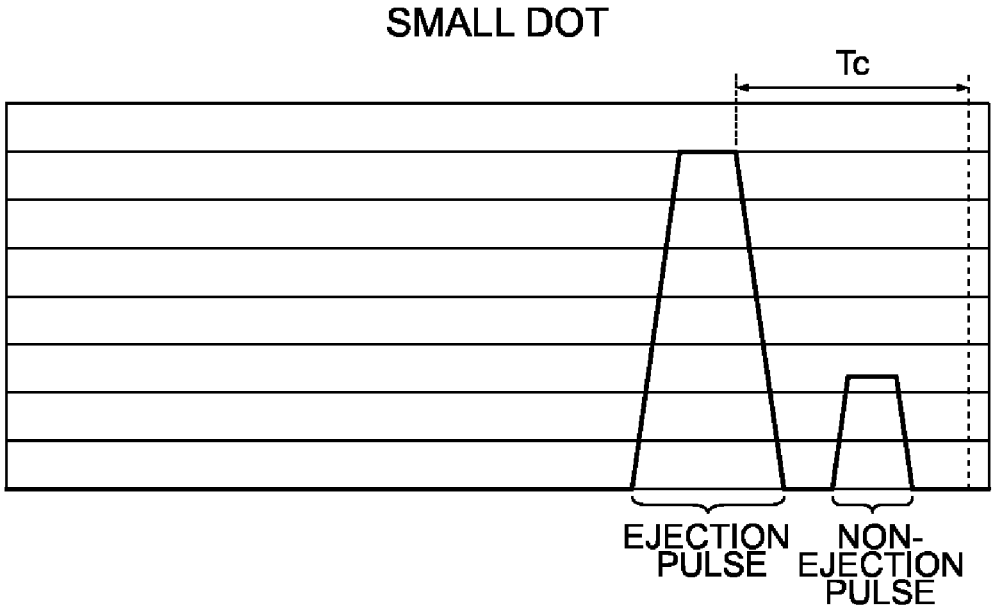
FIGS. 10A to 10D show another example of waveforms of the drive signal applied to an actuator.
Figure 10B:
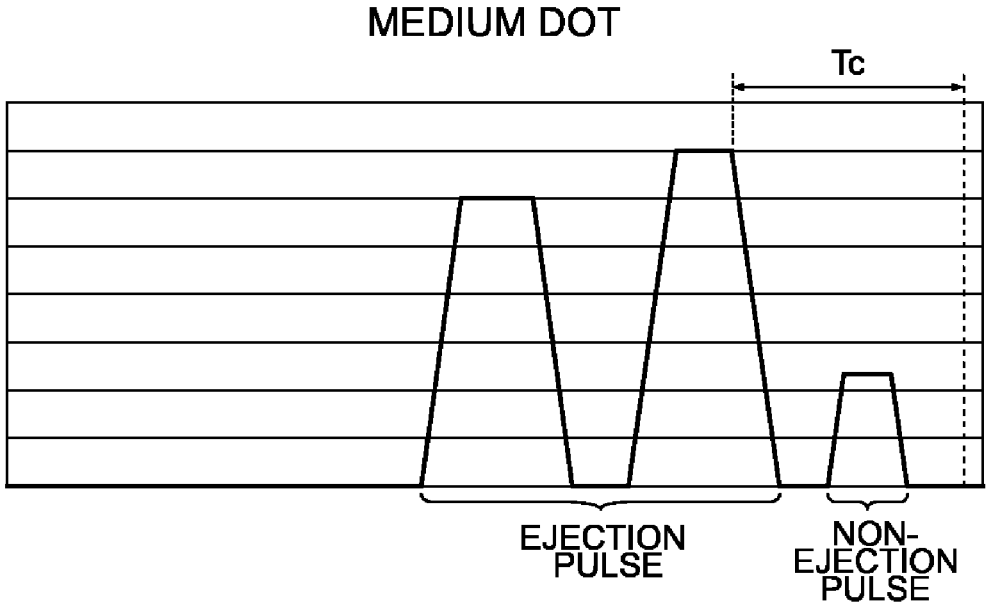
Figure 10C:
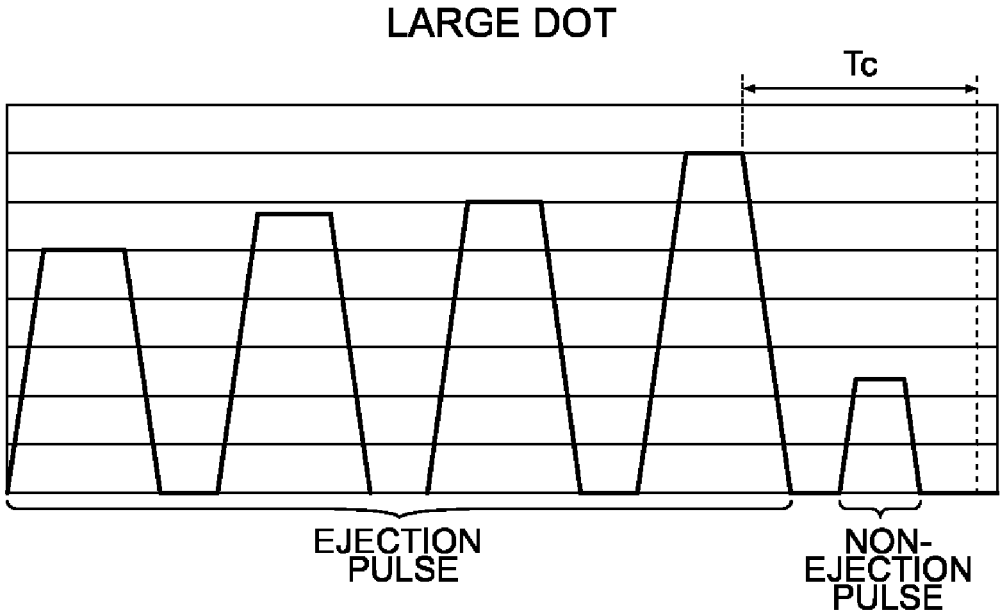
Figure 10D:
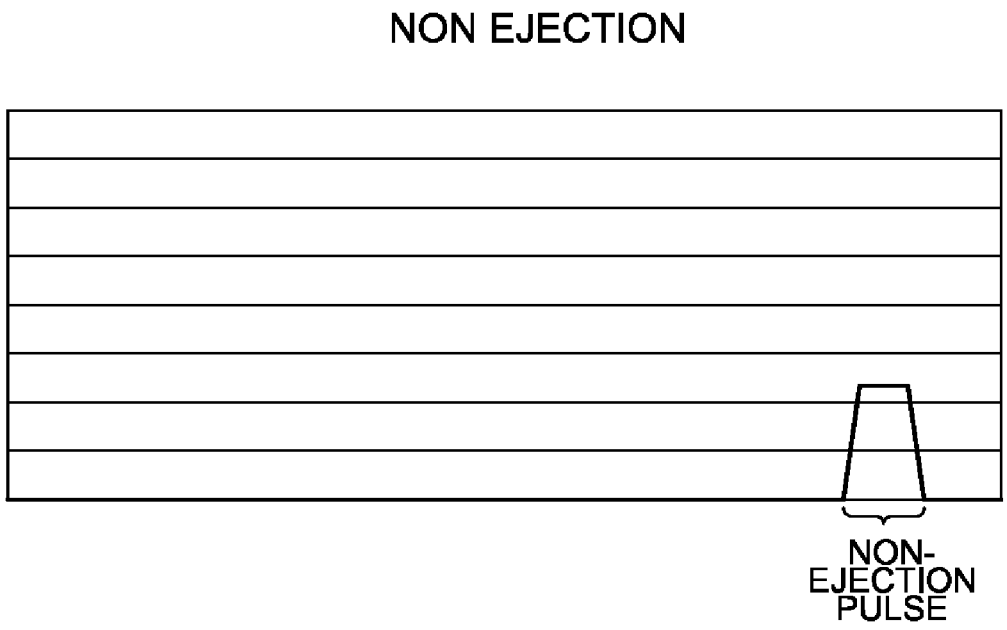

FIG. 10A shows a drive waveform for ejecting an ink droplet forming a small dot, FIG. 10B a drive waveform for ejecting an ink droplet forming a medium dot, and FIG. 10C a drive waveform for ejecting an ink droplet forming a large dot. FIG. 10D shows a drive waveform for not ejecting the ink.

As shown in FIGS. 10A to 10C, the ejection pulse(s) is incorporated at regular intervals. A small ink dot is formed by incorporating only one ejection pulse. A medium ink dot is formed by incorporating two ejection pulses. A large ink dot is formed by incorporating four ejection pulses.

As shown in FIGS. 10A to 10D, the non-ejection pulse is set to be incorporated always in the same position no matter whether the ink is ejected or not.

As described above, when incorporating the ejection pulses such that the peak values thereof increase gradually, image recording with different dot diameter can be performed by changing the number of ejection pulses to be incorporated, and accordingly a high quality image can be printed.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A method for driving an inkjet head, comprising the step of applying drive signals including an ejection signal used for ejecting ink and a non-ejection signal used for not ejecting the ink, to an actuator provided with a pressure chamber at a constant cycle so as to increase or reduce pressure in the pressure chamber in such a manner that the ink is ejected or not ejected from a nozzle connected with the pressure chamber, wherein:

a waveform of the ejection signal includes a combination of an ejection pulse for causing a droplet of the ink to be ejected from the nozzle and a non-ejection pulse for not causing a droplet of the ink to be ejected from the nozzle, the ejection pulse of the waveform of the ejection signal includes a part for reducing the pressure in the pressure chamber and a part for increasing the reduced pressure in the pressure chamber, the non-ejection pulse of the waveform of the ejection signal includes a part for reducing the pressure in the pressure chamber and a part for increasing the reduced pressure in the pressure chamber, the part for reducing the pressure in the pressure chamber of the non-ejection pulse of the waveform of the ejection signal is set to reduce the pressure in the pressure chamber while a tail of a droplet of the ink ejected from the nozzle by the ejection pulse is connected to the nozzle, the part for increasing the pressure in the pressure chamber of the non-ejection pulse of the waveform of the ejection signal is set to increase the pressure in the pressure chamber within a resonance period of the pressure chamber from a moment when the pressure in the pressure chamber is increased by the ejection pulse, and the non-ejection signal has a waveform including only a non-ejection pulse including a part for reducing the pressure in the pressure chamber and a part for increasing the reduced pressure in the pressure chamber, not to cause a droplet of the ink to be ejected from the nozzle.

2. The method for driving an inkjet head as defined in claim 1, wherein the non-ejection pulse which is incorporated in the waveform of the non-ejection signal is incorporated in a same position as the non-ejection pulse which is incorporated in the waveform of the ejection signal.

3. The method for driving an inkjet head as defined in claim 1, wherein a peak value of the non-ejection pulse is set equal to or greater than 10%, but not greater than 70%, of a maximum peak value of the ejection pulse.

4. The method for driving an inkjet head as defined in claim 1, wherein:

one or more of the ejection pulses are incorporated in the waveform of the ejection signal, a dot diameter of a droplet of the ink deposited on a recording medium is changed by changing number of the ejection pulses of the ejection signal, the part for reducing the pressure in the pressure chamber of the non-ejection pulse of the ejection signal is set to reduce the pressure in the pressure chamber while the tail of a droplet of the ink ejected from the nozzle by the last ejection pulse is connected to the nozzle, and the part for increasing the pressure in the pressure chamber of the non-ejection pulse of the ejection signal is set to increase the pressure in the pressure chamber within the resonance period of the pressure chamber from the moment when the pressure in the pressure chamber is increased by the last ejection pulse.

5. The method for driving an inkjet head as defined in claim 4, wherein a plurality of ejection pulses incorporated in the waveform of the ejection signal are set such that peak values of the plurality of ejection pulses increase gradually.

6. The method for driving an inkjet head as defined in claim 5, wherein the peak values of the plurality of ejection pulses increase gradually in such a manner that a droplet of the ink ejected subsequently from the nozzle catches up with a droplet of the ink ejected previously from the nozzle so as to be deposited on the recording medium in form of one droplet.

7. The method for driving an inkjet head as defined in claim 4, wherein a plurality of ejection pulses incorporated in the waveform of the ejection signal have a same peak value.

8. The method for driving an inkjet head as defined in claim 4, wherein a plurality of ejection pulses incorporated in the waveform of the ejection signal have a regular time interval.

9. An apparatus for driving an inkjet head, for applying drive signals including an ejection signal used for ejecting ink and a non-ejection signal used for not ejecting the ink, to an actuator provided with a pressure chamber at a constant cycle so as to increase or reduce pressure in the pressure chamber in such a manner that the ink is ejected or not ejected from a nozzle connected with the pressure chamber, wherein:

a waveform of the ejection signal includes a combination of an ejection pulse for causing a droplet of the ink to be ejected from the nozzle and a non-ejection pulse for not causing a droplet of the ink to be ejected from the nozzle, the ejection pulse of the waveform of the ejection signal includes a part for reducing the pressure in the pressure chamber and a part for increasing the reduced pressure in the pressure chamber, the non-ejection pulse of the waveform of the ejection signal includes a part for reducing the pressure in the pressure chamber and a part for increasing the reduced pressure in the pressure chamber, the part for reducing the pressure in the pressure chamber of the non-ejection pulse of the waveform of the ejection signal is set to reduce the pressure in the pressure chamber while a tail of a droplet of the ink ejected from the nozzle by the ejection pulse is connected to the nozzle, the part for increasing the pressure in the pressure chamber of the non-ejection pulse of the waveform of the ejection signal is set to increase the pressure in the pressure chamber within a resonance period of the pressure chamber from a moment when the pressure in the pressure chamber is increased by the ejection pulse, the non-ejection signal has a waveform including only a non-ejection pulse including a part for reducing the pressure in the pressure chamber and a part for increasing the reduced pressure in the pressure chamber, not to cause a droplet of the ink to be ejected from the nozzle, when a droplet of the ink is ejected from the nozzle, the ejection signal is applied to the actuator provided with the pressure chamber, and when a droplet of the ink is not ejected from the nozzle, the non-ejection signal is applied to the actuator provided with the pressure chamber.

10. The apparatus for driving an inkjet head as defined in claim 9, wherein the non-ejection pulse which is incorporated in the waveform of the non-ejection signal is incorporated in a same position as the non-ejection pulse which is incorporated in the waveform of the ejection signal.

11. The apparatus for driving an inkjet head as defined in claim 9, wherein a peak value of the non-ejection pulse is set equal to or greater than 10%, but not greater than 70%, of a maximum peak value of the ejection pulse.

12. The apparatus for driving an inkjet head as defined in claim 9, wherein:

one or more of the ejection pulses are incorporated in the waveform of the ejection signal, a dot diameter of a droplet of the ink deposited on a recording medium is changed by changing number of the ejection pulses of the ejection signal, the part for reducing the pressure in the pressure chamber of the non-ejection pulse of the ejection signal is set to reduce the pressure in the pressure chamber while the tail of a droplet of the ink ejected from the nozzle by the last ejection pulse is connected to the nozzle, and the part for increasing the pressure in the pressure chamber of the non-ejection pulse of the ejection signal is set to increase the pressure in the pressure chamber within the resonance period of the pressure chamber from the moment when the pressure in the pressure chamber is increased by the last ejection pulse.

13. The apparatus for driving an inkjet head as defined in claim 12, wherein a plurality of ejection pulses incorporated in the waveform of the ejection signal are set such that peak values of the plurality of ejection pulses increase gradually.

14. The apparatus of driving an inkjet head as defined in claim 13, wherein the peak values of the plurality of ejection pulses increase gradually in such a manner that a droplet of the ink ejected subsequently from the nozzle catches up with a droplet of the ink ejected previously from the nozzle so as to be deposited on the recording medium in form of one droplet.

15. The apparatus of driving an inkjet head as defined in claim 12, wherein a plurality of ejection pulses incorporated in the waveform of the ejection signal have a same peak value.

16. The apparatus of driving an inkjet head as defined in claim 12, wherein a plurality of ejection pulses incorporated in the waveform of the ejection signal have a regular time interval.

* * * * *